US006056312A

United States Patent [19]

Hogstedt

[11] Patent Number: 6,056,312

[45] **Date of Patent: *May 2, 2000**

[54] SNOWBOARD BOOT AND BINDING ASSEMBLY

[76] Inventor: Roy L. Hogstedt, 1075 Loma Ave., No. 205, Long Beach, Calif. 90804

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,996

[22] Filed: Jan. 20, 1998

[51] Int. Cl.[7] ..... A63C 9/10

[52] U.S. Cl. ..... 280/624; 280/14.2; 280/619; 280/613; 36/117.1

[58] Field of Search ..... 280/14.2, 624, 280/619, 613; 36/115, 117.1, 117.7; 24/269

[56] References Cited

U.S. PATENT DOCUMENTS

| | | | |
|---|---|---|---|
| 4,021,056 | 5/1977 | Oakes | 280/613 |
| 4,177,584 | 12/1979 | Reyl | 36/117 |
| 4,205,467 | 6/1980 | Salomon | 36/119 |
| 4,546,524 | 10/1985 | Kreft | 24/269 |
| 4,973,073 | 11/1990 | Raines et al. . | |
| 5,190,311 | 3/1993 | Carpenter et al. . | |
| 5,474,322 | 12/1995 | Perkins et al. . | |
| 5,505,478 | 4/1996 | Napoliello . | |
| 5,558,355 | 9/1996 | Henry . | |
| 5,564,719 | 10/1996 | Kisselmann . | |
| 5,577,757 | 11/1996 | Riepl et al. . | |
| 5,660,410 | 8/1997 | Alden . | |
| 5,661,876 | 9/1997 | Goldenberg | 24/269 |
| 5,695,210 | 12/1997 | Goss et al. | 280/624 |
| 5,697,631 | 12/1997 | Ratzek et al. | 280/613 |
| 5,820,155 | 10/1998 | Brisco | 280/607 |

FOREIGN PATENT DOCUMENTS

| | | | |
|---|---|---|---|
| 2561114 | 9/1985 | France | 280/613 |
| 1131521 | 12/1984 | U.S.S.R. | 280/613 |

*Primary Examiner*—J. J. Swann
*Assistant Examiner*—James S. McClellan
*Attorney, Agent, or Firm*—Leonard Tachner

[57] ABSTRACT

A contact configuration between boot and binding for snowboarding. Contact pins are provided on opposing sides of the boot at both the heel area and the toe area. This 4-point contact configuration assures heel and toe stability and reliable side boot restraint. Concave mating receptacles at matching locations on the binding assure easy and simple interconnection which is also secure and reliable. A release mechanism is provided to selectively retract the pins using a simple pull cord arrangement. Gear operated strap linkages permit more convenient tightening and loosening of the boot straps.

9 Claims, 5 Drawing Sheets

SNOWBOARD BOOT AND BINDING ASSEMBLY

BACKGROUND OF THE INVENTION

1. Field of the Invention

The present invention pertains generally to the field of snowboarding equipment and more particularly to a new configuration of snowboarding boots and bindings providing convenient grasp and release at distinct points of contact on opposing sides of toes and heels, respectively.

2. Prior Art

Various snowboard binding systems have been disclosed in the prior art. By way of example, U.S. Pat. Nos. 4,973,073; 5,190,311; 5,474,322; 5,505,478; 5,558,355; 5,564,719; 5,577,757 and 5,660,410 all disclose snowboard bindings and some disclose compatible boots or shoes. However, all have deficiencies in regard to the interface between the bindings and the boots. More specifically, most of the prior art discloses insufficient contact between boot and binding such as only two points or regions of contact on opposing middle positions of the boot. Such limited contact is inadequate because it permits heel and or toe lift which reduces control of the snowboard during critical maneuvers or requires a stiff sole for correct contact which is uncomfortable and reduces the rider's control and maneuverability. Other prior art provides heel and toe locking, but permits separation between boot and binding along the sides of the boot thereby reducing the security of the interface which detrimentally affects the confidence of the snowboarder. Moreover, the release mechanism for both types of prior art (i.e., side connections and heel and toe connections), is typically too cumbersome and complex making it either unreliable or too difficult to engage.

Therefore, despite the significant number of relevant prior art patent disclosures, there is still a need for a snowboard boot/binding configuration which provides sufficient interface contact to allow excellent control and security, while still offering a reliable and convenient release mechanism and comfortable flexible boots.

SUMMARY OF THE INVENTION

The present invention overcomes the deficiencies of the prior art by providing a unique contact configuration between boot and binding for snowboarding. More specifically, in the present invention, contact pins are provided on opposing sides of the boot at both the heel area and the toe area. This 4-point contact configuration assures heel and toe stability and reliable side boot restraint. Moreover, in the preferred embodiment of the invention, concave mating receptacles at matching locations on the binding guide the contact pins into binding apertures, assuring easy and simple interconnection which is also secure and reliable. Furthermore, a release mechanism is provided to selectively retract the pins using a simple pull cord arrangement which is both convenient and effective despite being mechanically simple and therefore reliable. An optimal advantageous feature of the present invention, resides in gear operated strap linkages which permit more convenient tightening and loosening of the boot straps.

OBJECTS OF THE INVENTION

It is therefore a principal object of the present invention to provide an improved snowboard boot and binding which overcomes the deficiencies of the prior art.

It is another object of the invention to provide a snowboard boot and binding wherein a 4-point interface is used to selectively secure the boot to the binding.

It is yet another object of the invention to provide a snowboard boot and binding having both quick connect and quick release capability.

It is still an additional object of the invention to provide a snowboard boot and binding which offers greater security and control and quicker connect and disconnect as compared to the prior art.

It is still an additional object of the invention to provide a snowboard boot having more convenient strap tightening and loosening devices.

It is still another object of the invention to provide a snowboard boot and binding with a more flexible, comfortable boot allowing the rider greater control and maneuverability.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
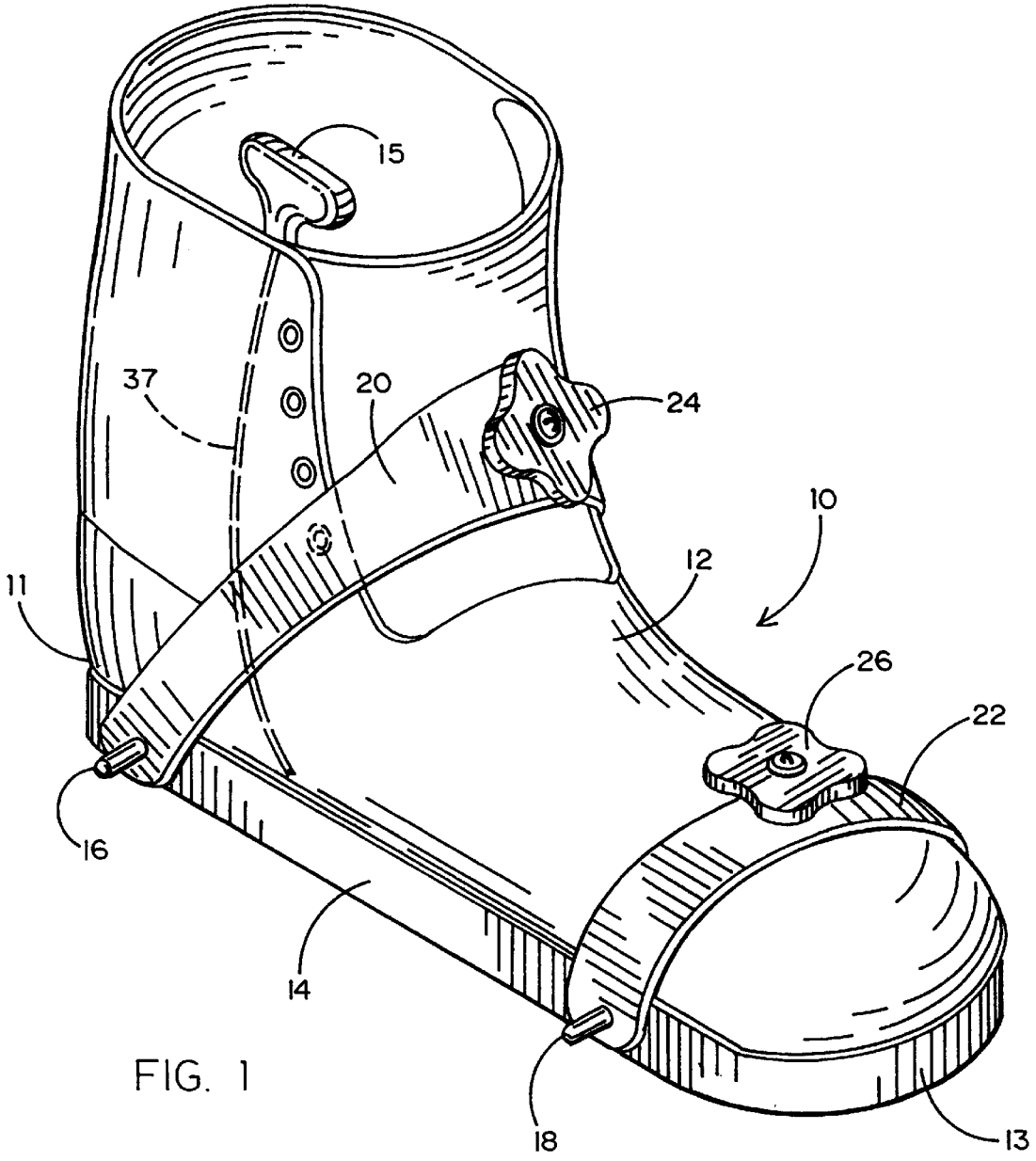
FIG. 1 is a three-dimensional view of a snowboard boot in accordance with the preferred embodiment of the invention.

Referring now to the accompanying figures, it will be seen that a snowboard boot 10 of the present invention comprises an upper member 12 and a lower member 14. Four pins 16, 17, 18 and 19, extend laterally from the lower member 14 in a direction which is substantially perpendicular to the length of the boot 10. The pins are located adjacent the heel and toe portions of the boot, but inward from the heel 11 and front 13 of the boot, respectively. The pins are positioned on opposite sides of the lower member 14. Boot 10 also comprises straps 20 and 22 which in the illustrated embodiment, use adjustment knobs 24 and 26, respectively to tighten and loosen the straps in a manner to be disclosed in detail below.

Figure 2:
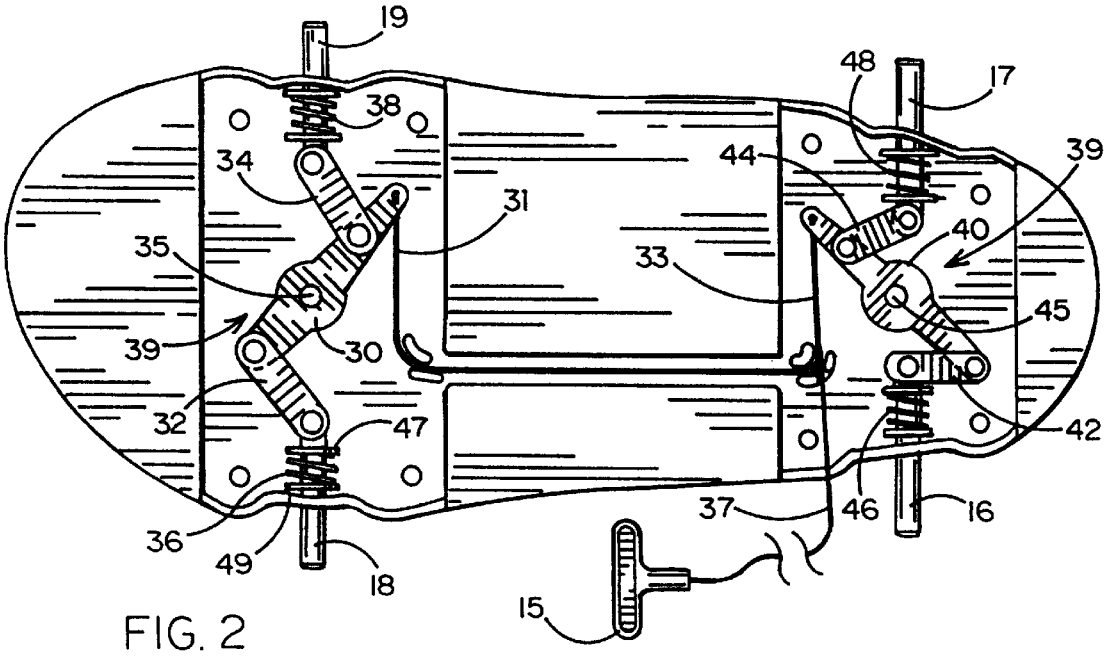
FIG. 2 is a bottom view of the boot of FIG. 1 but shown partially disassembled.
Figure 3:
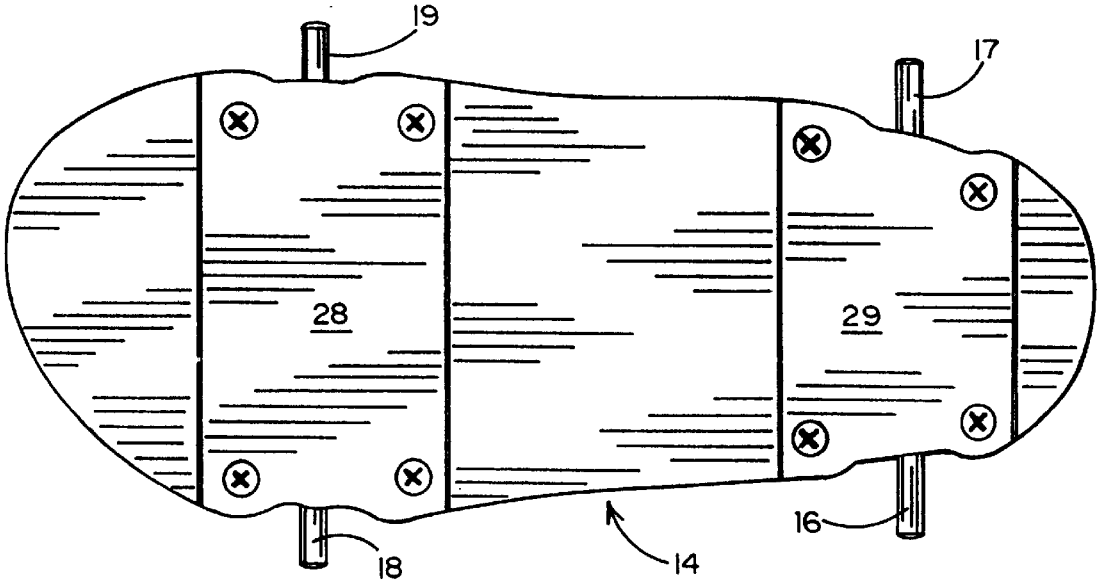
FIG. 3 is a bottom view similar to FIG. 2 but with the boot shown assembled.

It may be seen in FIGS. 2 and 3 that lower member 14 has a pair of compartments 39, access to which may be obtained by removing covers 28 and 29. Each compartment 39 houses a structure for extending and retracting pins 16, 17, 18 and 19. By way of illustration, pins 18 and 19 are each connected to a pin retractor 30 through linkages 32 and 34. Retractor 30 is secured at its center to a fulcrum 35 about which the retractor may be rotated through a limited angle. It can be seen that each pin is passed through a helical spring immediately inside the perimeter of the compartment. Thus pin 18 passes through spring 36 and pin 19 passes through spring 38. The springs are positioned between spaced apart washers such as washers 47 and 49 on pin 18. Washer 49 is affixed to the pin 18 while washer 47 is affixed to the boot. Springs 36 and 38 provide a nominal extended condition of pins 18 and 19. When retractor 30 is rotated (clockwise as seen in FIG. 2), linkages 32 and 34 pull pins 18 and 19 inside compartment 39 while compressing springs 36 and 38. Retractors 30 and 40 (the latter controlling retraction of pins 16 and 17), are attached to pull-cables 31 and 33, respectively and both such pull-cables are connected to main pull-cable 37 which is, in turn, attached to handle 15. Of course, it will be understood that pins 16 and 17 respond in the same manner to fulcrum 45 through linkages 42 and 44. Thus, when handle 15 is pulled, both retractors rotate and all four pins are retracted into the boot 10. When handle 15 is released, the springs 36, 38, 46 and 48 all expand and again extend the pins to the positions shown in FIGS. 1–3.

Figure 4:
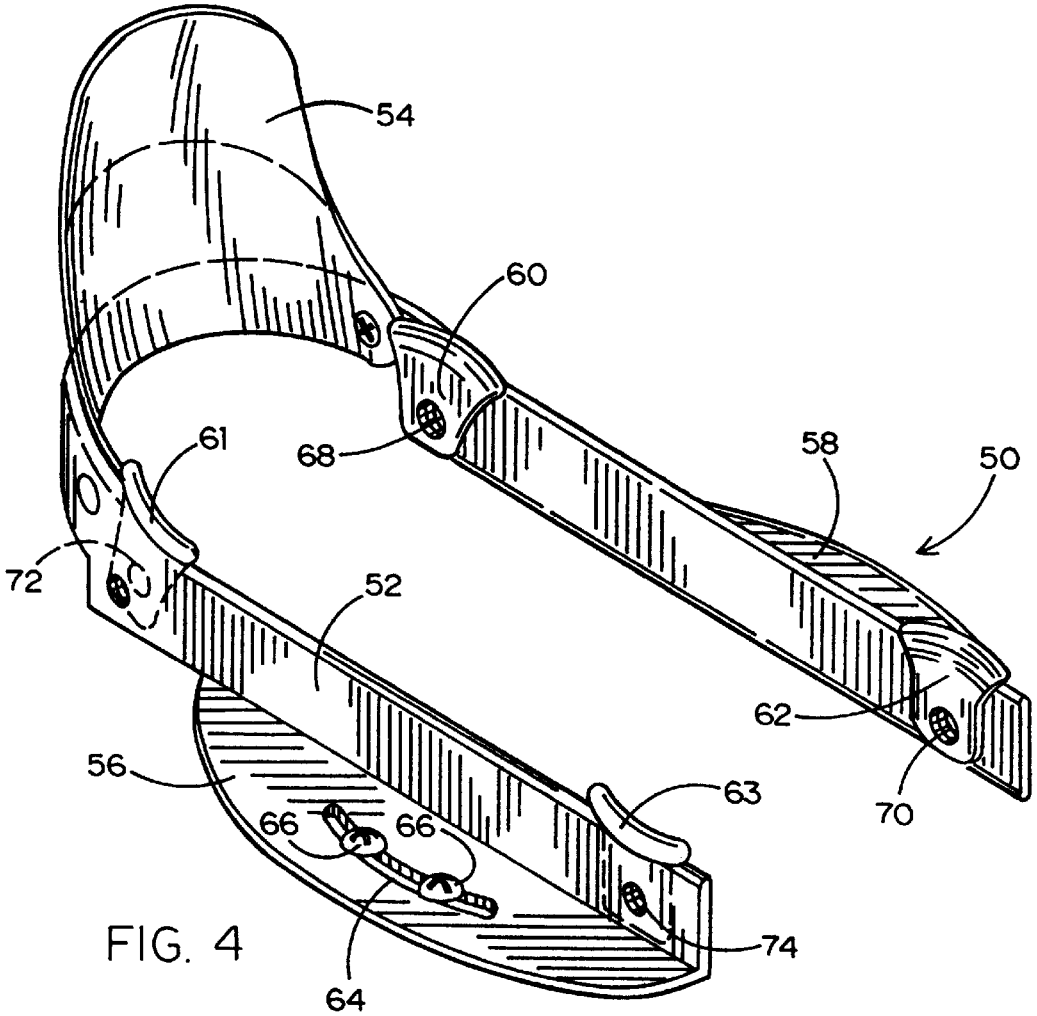
FIGS. 4 and 5 are three-dimensional and plan views, respectively, of the binding of the preferred embodiment of the invention.
Figure 5:
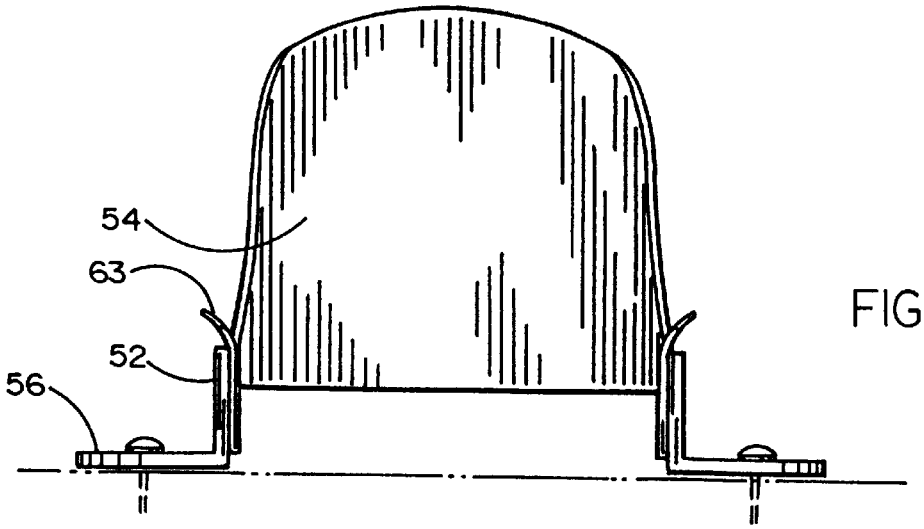
Figure 6:
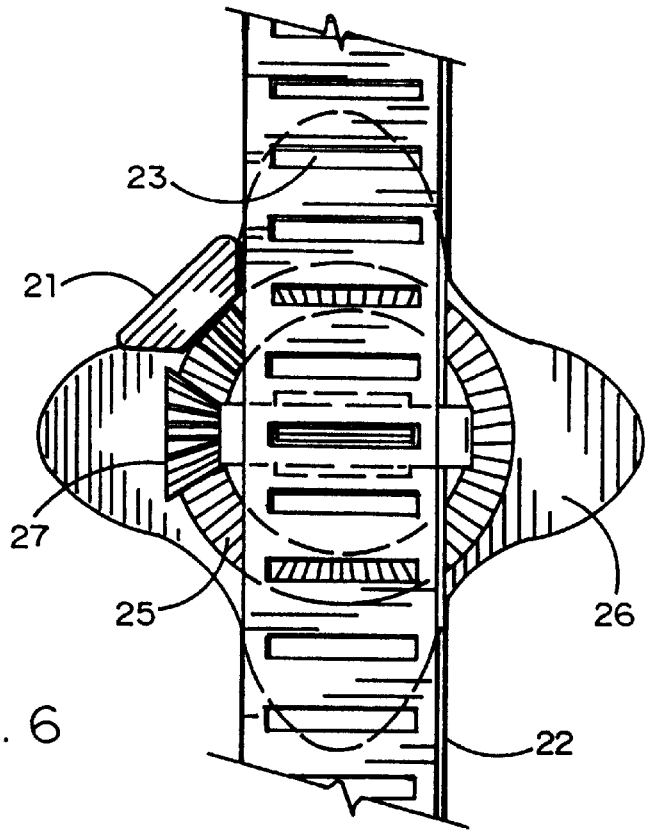
FIGS. 6 and 7 are top and bottom views respectively, of an optional strap-tightening feature of the invention.
Figure 7:
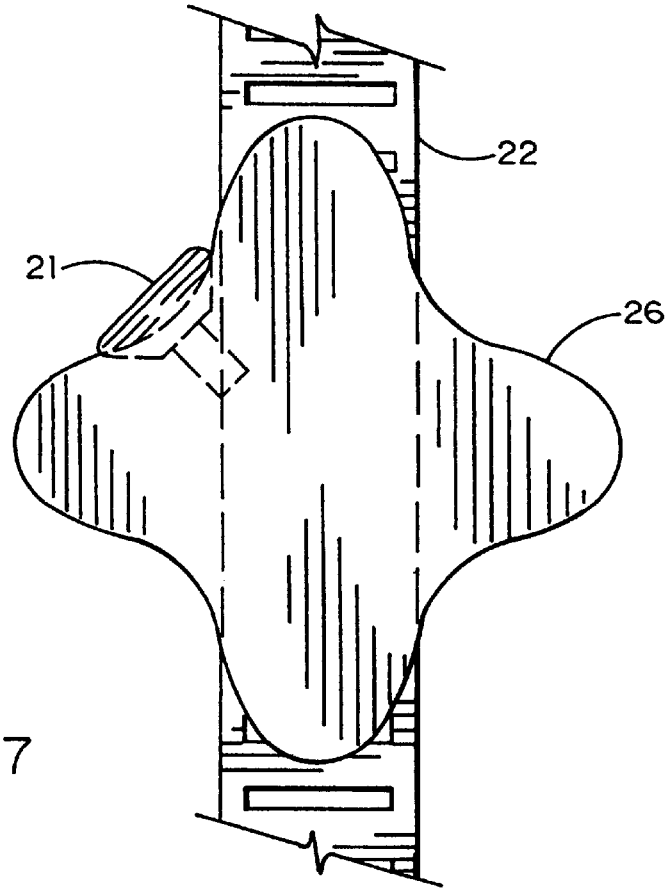
Figure 8:
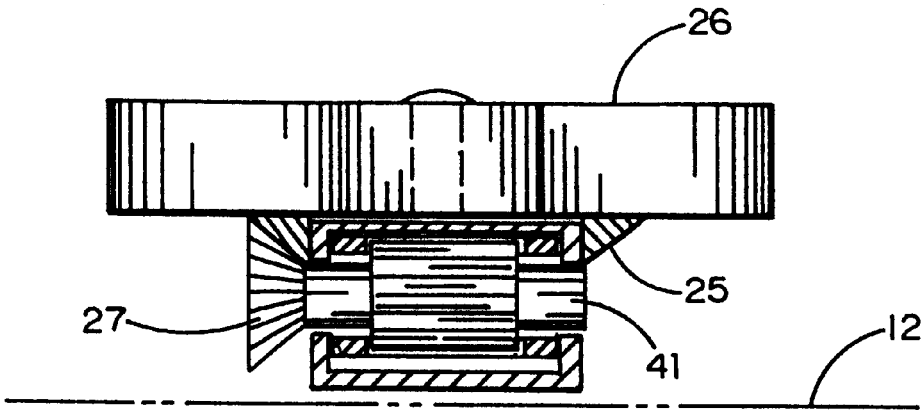
FIGS. 8 and 9 are front and side views, respectively, of the strap-tightening feature of FIGS. 6 and 7.
Figure 9:
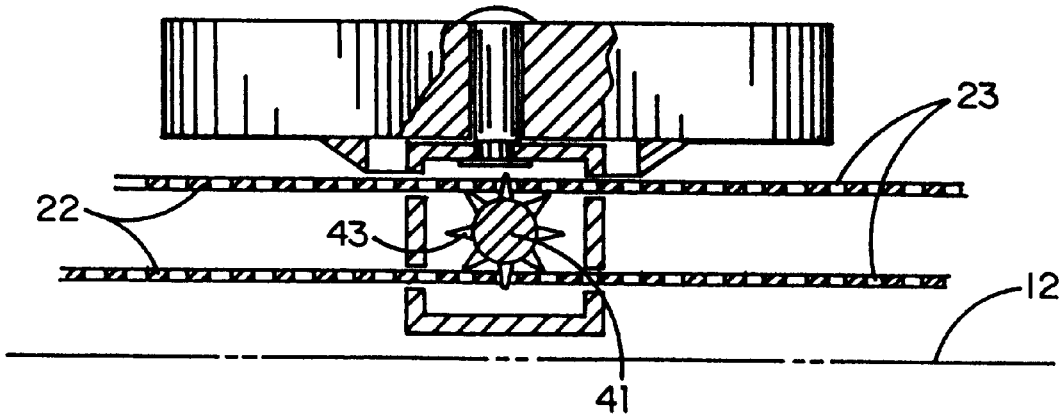

The binding 50 with which the boot 10 is designed to operate, is shown in FIGS. 4 and 5. As seen in those FIGs., snowboard binding 50 comprises a U-shaped frame 52, a rear support 54, a pair of board attachment flanges 56, 58, four pin mating receptacles 60, 61, 62, and 63 and four pin apertures 68, 70, 72 and 74. Support 54 provides both support and locating functions to facilitate placement of the boot 10 in the binding 50. Flanges 56 and 58 provide means for attaching the binding to the board while an adjustment slot 64 and set screws 66 in such flange permit adjustment of binding angle on the underlying board.

Mating receptacles 60 through 63 are shaped with a concave surface facing inwardly and which tends to feed the pin into the corresponding aperture 68 through 74. The boot is recessed around each pin to receive receptacles 60–63 and thus assure a snug fit. These funnel-like surfaces and the spring-like pin retraction, make it far easier to feed the pins into the pin apertures without difficulty or delay.

An advantageous but optional feature of the disclosed embodiment is found in the strap tightening and loosening mechanism depicted in FIGS. 6 through 9. The belt adjustment knob 26 provides an inclined gear tread 25 which engages a gear 27, the latter being integral to a shaft 41. The shaft 41 provides a plurality of radial teeth 43. Belt 22 has discrete overlapping ends and a plurality of regularly spaced slots 23. The belt ends engage opposite sides of shaft 41 and its teeth 43. Rotation of knob 26 tightens and loosens belt 22 depending upon the direction of knob rotation. A knob-lock 21 (shown in FIGS. 6 and 7) may be provided to prevent inadvertent movement of the knob 26 and to allow tightening under tension.

Thus it will be seen that the illustrated embodiment satisfies all of the objects of the invention heretofore indicated. Moreover, the present invention clearly provides improved performance, control, stability and ease of use for snowboard boot/binding interface. Interconnection is superior, attachment and release are more convenient and the preferred structure is simple and low cost.

Having thus disclosed the presently contemplated best mode of the invention for purposes of explaining the structure and operation thereof, it being understood that the disclosed embodiment is illustrative and not limiting, what I claim is:

What is claimed is:

1. A boot and binding assembly for snowboards, the assembly providing selective interconnection between the binding attached to the snowboard and at least one boot worn by a snowboard user; the assembly comprising:

a boot having an upper member and a lower member and having at least four projection devices extending from opposing sides of the boot along said lower member, two of said devices being closer to the rear of said boot and two of said devices being closer to the front of said boot; and a binding having at least four receptacles for receiving said boot projection devices; and projection device attachment means for selectively retracting said projection devices to permit separation of said boot and said binding;

said projection device attachment means defining a pair of rotatable displaceable linkage members, each of said linkage members coupled to a respective pair of said projecting devices; and, a pull string coupled to both of said linkage members for rotationally actuating each of said linkage members simultaneously and simultaneously displacing said projection devices;

wherein said binding further comprises a curved rear support for abutting said boot.

2. The assembly recited in claim 1 wherein said projection devices comprise elongated pins and said receptacles comprise apertures sized to receive said pins.

3. The assembly recited in claim 2 wherein said elongated pins are spring loaded to nominally extend beyond the lower member of said boot.

4. The assembly recited in claim 2 wherein said receptacles are shaped to funnel said pins into said apertures.

5. The assembly recited in claim 1 further comprising at least one strap member overlying said upper member of said boot and an adjustment knob positioned for tightening and loosening said strap member.

6. The assembly recited in claim 5 wherein said strap member comprises regularly spaced slots and wherein said adjustment knob comprises a gear-operated shaft having teeth extending into said slots for tightening and loosening said strap member depending upon the direction of rotation of said adjustment knob.

7. A boot and binding assembly for snowboards, the assembly providing selective interconnection between the binding attached to the snowboard and at least one boot worn by a snowboard user; the assembly comprising:

a boot having an upper member and a lower member and having at least four projection devices extending from opposing sides of the boot along said lower member, two of said devices being closer to the rear of said boot and two of said devices being closer to the front of said boot; and a binding having at least four receptacles for receiving said boot projection devices; and means attached to said projection devices for selectively retracting said devices to permit separation of said boot and said binding;

said projection devices comprising elongated pins and said receptacles comprising apertures sized to receive said pins; said elongated pins being spring loaded to nominally extend beyond the lower member of said boot; said receptacles being shaped to funnel said pins into said apertures; said means for retracting comprising a pair of rotatable arms within said lower member, each of said rotatable arms attached to two of said projection devices and a pull cord attached to an end of each of said arms for simultaneously rotating each of said arms for simultaneously retracting said projection devices, said cord being also attached to a handle accessible to a snowboard user;

wherein said binding further comprises a curved rear support for abutting said boot.

8. The assembly recited in claim 7 further comprising at least one strap member overlying said upper member of said boot and an adjustment knob positioned for tightening and loosening said strap member.

9. The assembly recited in claim 8 wherein said strap member comprises regularly spaced slots and wherein said adjustment knob comprises a gear-operated shaft having teeth extending into said slots for tightening and loosening said strap member depending upon the direction of rotation of said adjustment knob.

* * * * *